United States Patent [19]

Nukaya

[11] Patent Number: 5,073,795

[45] Date of Patent: Dec. 17, 1991

[54] ELECTROPHOTOGRAPHY TYPE IMAGE FORMING APPARATUS HAVING IMPROVED EXCHANGING KIT

[75] Inventor: Yasuyuki Nukaya, Tokyo, Japan

[73] Assignee: Ricoh Company, Ltd., Tokyo, Japan

[21] Appl. No.: 544,195

[22] Filed: Jun. 26, 1990

[30] Foreign Application Priority Data

Jun. 30, 1989 [JP] Japan ..... 1-166961

[51] Int. Cl.[5] ..... G03G 15/00

[52] U.S. Cl. ..... 355/210; 346/160; 355/260

[58] Field of Search ..... 355/210, 211, 212, 219, 355/200, 260, 215, 228, 271, 67, 71, 245; 346/160; 358/401, 408, 471

[56] References Cited

U.S. PATENT DOCUMENTS

| | | | |
|---|---|---|---|
| 3,883,242 | 3/1975 | Takahashi | 355/210 |
| 4,823,002 | 4/1989 | Saito | 250/235 |
| 4,841,333 | 6/1989 | Damji | 355/211 |
| 4,849,785 | 7/1989 | Tanabe | 355/211 X |
| 4,965,633 | 10/1990 | Surti | 355/200 |
| 4,970,552 | 11/1990 | Okamoto et al. | 355/215 |

FOREIGN PATENT DOCUMENTS 146282 9/1982 Japan .

*Primary Examiner*—A. T. Grimley
*Assistant Examiner*—Sandra L. Brase
*Attorney, Agent, or Firm*—Cooper & Dunham

[57] ABSTRACT

An image forming apparatus includes a photosensitive member, a charger unit provided at a charging station around the photosensitive member, a writing optical system housed in a housing and which casts the optical image of a document image onto the photosensitive member, the housing having a projection opening through which a light beam passes through and an exchanging kit. The exchanging kit includes a developing unit provided at a developing stage around the photosensitive member and a dustproof cover integrated with the developing unit, the dustproof cover having a dustproof glass through which the light beam passes. Furthermore, the exchanging kit is detachably provided around the photosensitive member.

11 Claims, 2 Drawing Sheets

ELECTROPHOTOGRAPHY TYPE IMAGE FORMING APPARATUS HAVING IMPROVED EXCHANGING KIT

BACKGROUND OF THE INVENTION

The present invention generally relates to an electrophotography type image forming apparatus, and more particularly to an image forming apparatus capable of easily preventing the quality of a picture from deteriorating.

In an image forming apparatus, such as a laser beam printer and an electrophotography copying machine, using an electrophotography processes, a charging unit, a developing unit and a transfer charging unit are successively arranged along a surface of a photosensitive body in a moving direction thereof. The image forming apparatus also has an optical system which casts the optical image of a document onto the surface of the photosensitive body between the charging unit and the developing unit. A station where the optical image casting is performed by the optical system is termed an exposing station. Then, the charging unit uniformly applies a charge to the surface of the photosensitive body, and the optical system casts the optical image onto the charged surface of the photosensitive body so that a electrostatic latent image corresponding to the optical image is formed. The electrostatic latent image formed on the surface of the photosensitive body is developed by the developing unit. That is, the toner from the developing unit is deposited on the electrostatic latent image so that a toner image ( developed image ) corresponding to the electrostatic latent image is formed. Then, a sheet to which a charge is applied to a back thereof by the transfer charger comes into contact with the toner image formed on the surface of the photosensitive body. As a result, the toner image leaves the surface of the photosensitive body and is transferred to the surface of the sheet. After the toner image is transferred to the sheet, the sheet is separated from the photosensitive body and the toner image is pressed into the sheet by a fusing unit. By the process as has been described above, an image is formed onto the sheet.

The optical system is housed in a housing to protect it against dust and prevent light leakage, or a shield plate is provided between the optical system and a part on the photosensitive body where the optical image is cast. A projection opening is provided on the housing or the shield plate so that the optical system can cast the optical image through the projection opening onto the photosensitive body.

A suspended toner is leaked through a gap formed between an edge of an opening on a housing of the developer unit and the photosensitive body. Since the exposing station is adjacent to a developing station where the developing is performed by the developer unit, there is a possibility of the suspended toner going through the projection opening in the housing of the optical system. To improve the reliability of conveying sheets and to facilitate a paper jam operation, an image forming apparatus such as a laser beam printer having a special structure is proposed. In this image forming apparatus having the special structure, the exposing station above mentioned is provided under the photosensitive body and a transfer station where the toner image is transferred from the photosensitive body to the sheet is provided above the photosensitive body. Particularly, in the image forming apparatus having the special structure described above, a gap between the edge of the opening on the housing of the developer unit and the photosensitive body is above the projection opening of the housing of the optical system so that the toner leaked through the gap directly falls on the projection opening and the suspended toner subsides and easily goes into the housing of the optical system. Accordingly, the projection opening formed on the housing of the optical system is sealed up by a cylindrical lens, which is one of the optical elements of the optical system, or a glass plate. In addition, a dustproof glass is detachably provided at a predetermined position so as to cover the projection opening. When the toner from the developer unit adheres to the surface of the dustproof glass, the dustproof glass is removed and the toner is wiped from the dustproof glass. Then, the dustproof glass from which the toner is wiped is set at the predetermined position again.

The suspended toner also adheres to the charger unit so that the charging characteristic of the charger unit deteriorates.

Conventionally, the dustproof glass and the charger unit are, respectively, removed from the housing of the image forming apparatus and wiped, and then they are reset as before. The dustproof glass and the charger can also be exchanged. However, because of the positions where they are set, it is difficult to either remove or exchange them. Accordingly, a cleaning mechanism for cleaning the dustproof glass has been proposed in Japanese Laid- Open Patent Application No. 57-146282. In this cleaning mechanism, when a process unit is removed and then set as before, a cleaning member, which is formed of polyurethane foam or the like, provided on the process unit wipes the surface of the dustproof glass. However, it is difficult for the cleaning mechanism to completely wipe the toner adhered on the surface of the dustproof glass away from the surface thereof. Instead, there are many cases where the toner is spread on the dustproof glass. In the image forming apparatus such as a laser beam printer in which a high resolution is required, due to the dust on the optical system, picture quality considerably deteriorates.

In a small size laser printer or the like, the user exchanges components thereof so that the developing unit is exchanged when there is no toner in the developing unit.

SUMMARY OF THE INVENTION

Accordingly, a general object of the present invention is provide a novel and useful image forming apparatus in which the disadvantages of the aforementioned prior art are eliminated. That is, the present invention is directed to overcoming the above described disadvantage of the conventional art which occurs when the dustproof glasses of the optical system and the charger unit are removed and then reset as before or wiped.

A more specific object of the present invention is to provide an image forming apparatus capable of preventing picture quality from deteriorating due to a unit being exchanged by a simple operation and at a suitable time.

The above objects of the present invention can be achieved by an image forming apparatus comprising a photosensitive member, a charger unit provided at a charging station around the photosensitive member for uniformly charging the photosensitive body, a writing optical system housed in a housing for casting the optical image of a document image onto the photosensitive member, the housing having a projection opening through which a light beam corresponding to the optical image from the writing optical system passes, and an exchanging kit having a developing unit provided at a developing stage around the photosensitive member for developing a electrostatic latent image formed by casting the optical image on the photosensitive member, a dustproof cover integrated with the developing unit and covering the projection opening of the housing of the writing optical system, the dustproof cover having a dustproof glass through which the light beam passes through the projection opening, and the exchanging kit being detachably provided around the photosensitive member, wherein the writing optical system casts the optical image between the charging station and the developing station on the photosensitive member.

The above objects of the present invention can be also achieved by an image forming apparatus comprising a photosensitive member, a writing optical system housed in a housing for casting the optical image of a document image onto the photosensitive member, the housing having a projection opening through which a light beam corresponding to the optical image from the writing optical system passes, and an exchanging kit having a developing unit provided at a developing stage around the photosensitive member for developing an electrostatic latent image formed by casting the optical image on the photosensitive body, a dustproof cover integrated with the developing unit and covering the projection opening of the housing and a charger unit provided at a charging station around the photosensitive member for uniformly charging the photosensitive member, the dustproof cover having a dustproof glass through which the light beam entering through the projection opening passes, and the charger unit being integrated with the dustproof cover, wherein the writing optical system casts the optical image between the charging station and the developing station on the photosensitive member.

Addition objects, features and advantages of the present invention will become apparent from the following detailed description when read in conjunction with the accompanying drawings.

DESCRIPTION OF THE PREFERRED EMBODIMENTS

Figure 1:
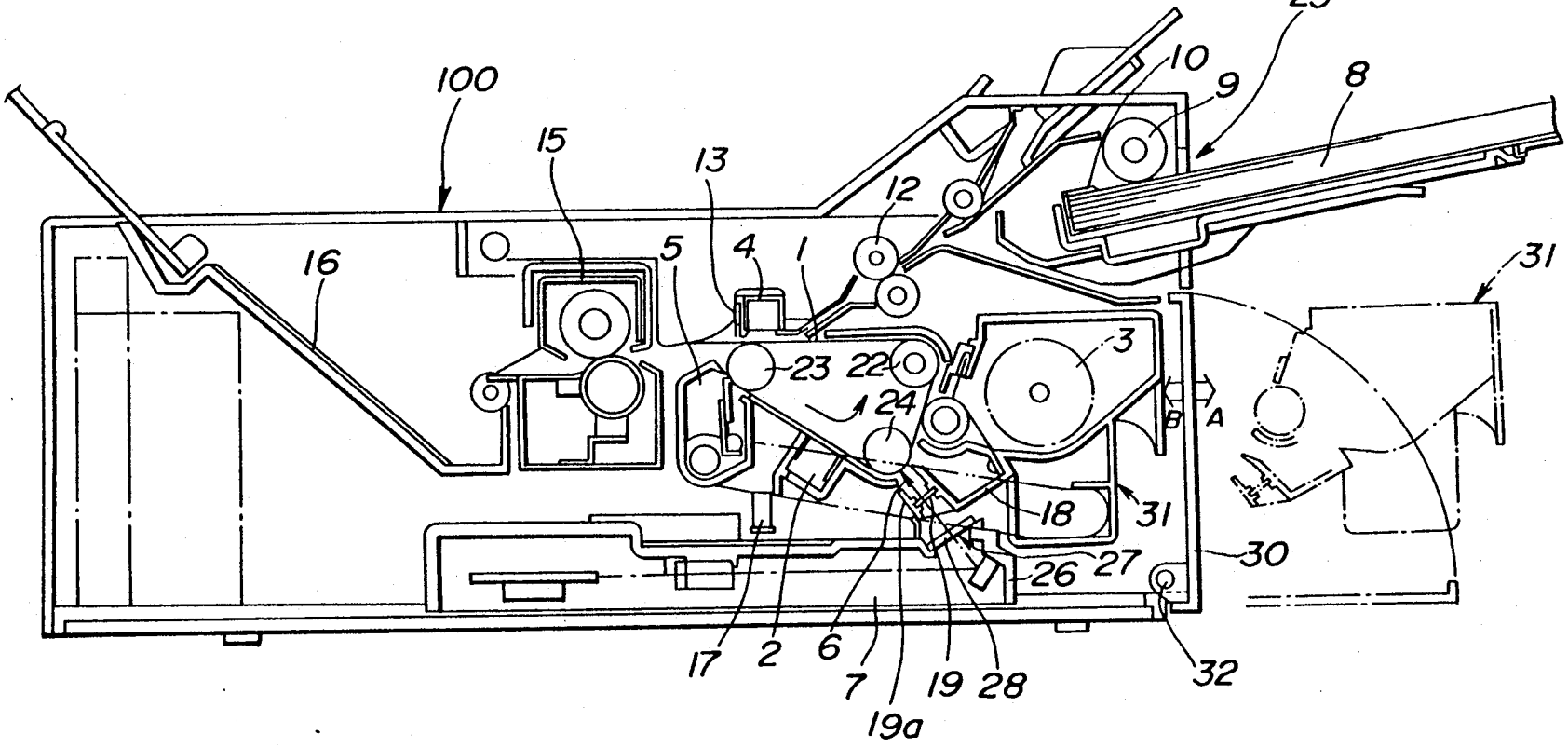
FIG. 1 is a front sectional view showing a whole structure of an image forming apparatus of a first preferred embodiment according to the present invention.

A description will now be given of a first preferred embodiment of the present invention with reference to FIG.1. FIG.1 shows a laser printer having the structure where the exposing station is provided under the photosensitive body and a transfer station is provided above the photosensitive body.

A photosensitive belt 1 is wound round rollers 22, 23 and 24. The photosensitive belt 1 moves in the direction shown by an arrow ( counterclockwise direction in FIG.1 ) due to the rotation of rollers 221, 23 and 24. A charger unit 2, a developing unit 3, a transfer charger unit 4, a cleaning unit 5 and a discharger unit 17 are successively arranged around the photosensitive belt 1 in the direction of the moving of the photosensitive belt 1 shown by the arrow. The charger unit 2 is positioned under the photosensitive belt 1, and an optical writing unit 7 is provided under the photosensitive belt 1, the developing unit 3 and the cleaning unit 5 are on a bottom portion of a housing 100. The optical writing unit 7 casts an optical image of the document image onto the photosensitive belt 1 between the charger unit 2 and the developing unit 3. That is, the exposing station 6 is provided under the photosensitive belt 1 and between the charger unit 2 and the developing unit 3. The transfer charger 4 is provided above the photosensitive belt 1. A cassette 8 housing sheets is detachably set in an inlet portion 25 formed on the right side, in FIG.1, of the housing 100. The sheets in the cassette 8 are separated from each other by a feed roller 9 and a corner nail 10 and are fed toward a pair of registration rollers 12. The pair of registration rollers 12 feed each sheet from the cassette 8 to a transfer station where the transfer charger unit 4 is provided. The feed timing of each sheet is adjusted by the pair of registration rollers 12 so that an area on the photosensitive belt 1 where the toner image is formed faces to the sheet. Then, the toner image on the photosensitive belt 1 is transferred to the sheet by the operation of the transfer charger 4.

A tray 16 is provided in a side portion of the housing 100 opposite to the side portion having the cassette 8. In a path between the transfer station and the tray 16, a discharging brush 13 and a fusing unit 15 are respectively provided. Then, the sheet to which the toner image is transferred is conveyed through stations provided with the discharging brush 13 and the fusing 15, and the sheet is discharged to the tray 16.

The process for image forming in units described above is known so that a detailed description of such process is omitted.

The writing optical unit 7 is housed in a housing 26. The housing 26 has a projection opening 27, and the projection opening 27 is covered by a transparent glass plate 28. A dustproof glass 19 is provided between the glass plate 28 covering the projection opening 27 and the exposing station 6. The glass plate 28 covering the projection opening 27 is covered by a dustproof cover **19*a*. The dustproof cover 19*a* has an opening through which a laser beam emitted from the writing optical system 7 passes, and an edge of the opening supports an edge of the dustproof glass 19. The dustproof cover 19*a* is integrated with a frame 18 of the developing unit 3. The developing unit 3 and the dustproof cover 19*a* supporting the dustproof glass 19 make up one exchanging kit 31. A door 30 is provided on a side of the housing 100 and under the inlet potion 25. The door 30 pivots on a shaft 32 which is provided on the bottom of the housing 100 so as to be capable of opening and shutting. The door 30 is opened by pivoting thereof so that the exchanging kit 31 is exposed. Then, a fixing mechanism for fixing the exchanging kit 31 at a predetermined regular position is released so that it becomes possible for the exchanging kit 31 to be pulled out from the housing 100. The exchanging kit 31 is pulled out in a direction shown by an arrow (A) from the housing 100, and a new exchanging kit 31 is inserted in a direction shown by an arrow (B) into the housing 100. Then, the new exchanging kit 9** is set at the regular position, and is fixed by the fixing mechanism at the regular position.

That is, the exchanging kit 31 made up of the developing unit 3 and the dustproof cover 19*a* is capable of exchanging and old exchanging kit for a new one.

Since the laser beam printer has a structure as has been described above, it is possible to prevent the toner from leaking from the developing unit 3 and dust from going into the dustproof cover 19*a*. Even if they go into the dustproof cover 19*a*, the toner and the dust adhere on the dustproof glass 19 so that it is possible to prevent the toner and the dust from making the plate glass 28 covering the projection opening 27 dirty and from going into the housing 26 of the writing optical system 7.

When a predetermined amount of the toner in the developing unit 3 has been consumed for developing the latent image, the developing unit 3 must be exchanged. When exchanging the developing unit 3, the door 30 of the housing 100 is opened, the exchanging kit 31 is pulled out as shown by the one dotted line in FIG.1 and the exchanging kit 31 is exchanged. Since the developing unit 3, the dustproof cover 19*a* and the dustproof glass 19 are integrated in the exchanging kit 31, the exchanging kit 31 is exchanged so that the dustproof glass 19 is exchanged for a new one at the same time that the developing unit 3 is exchanged.

Figure 2:
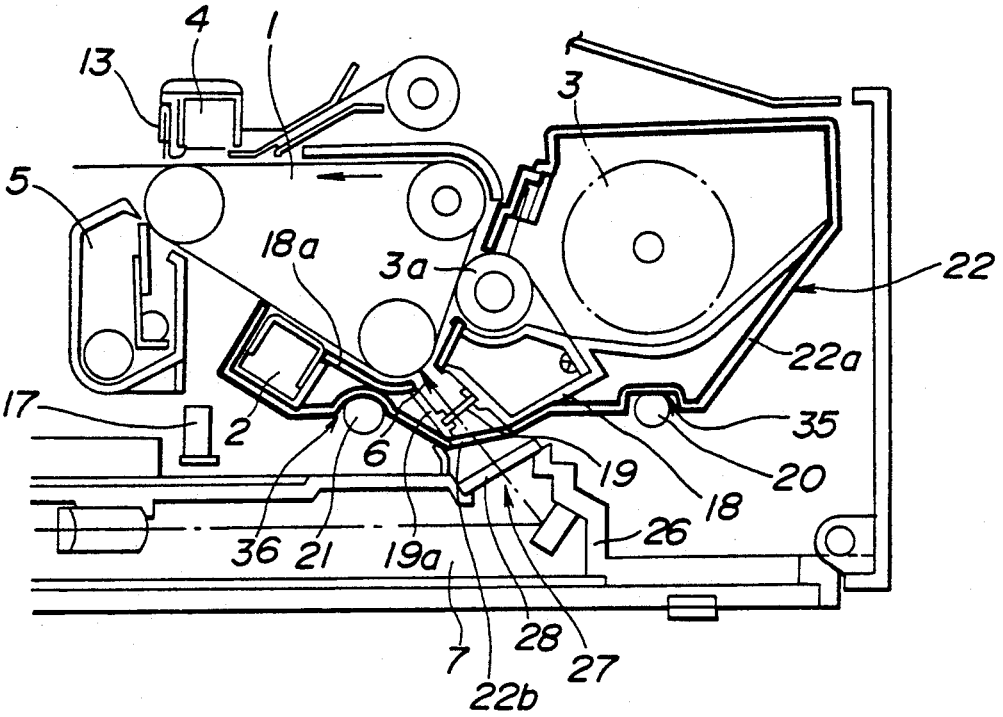
FIG. 2 is a front sectional view showing a structure adjacent to a photosensitive body of a second embodiment according to the present invention.
Figure 3:
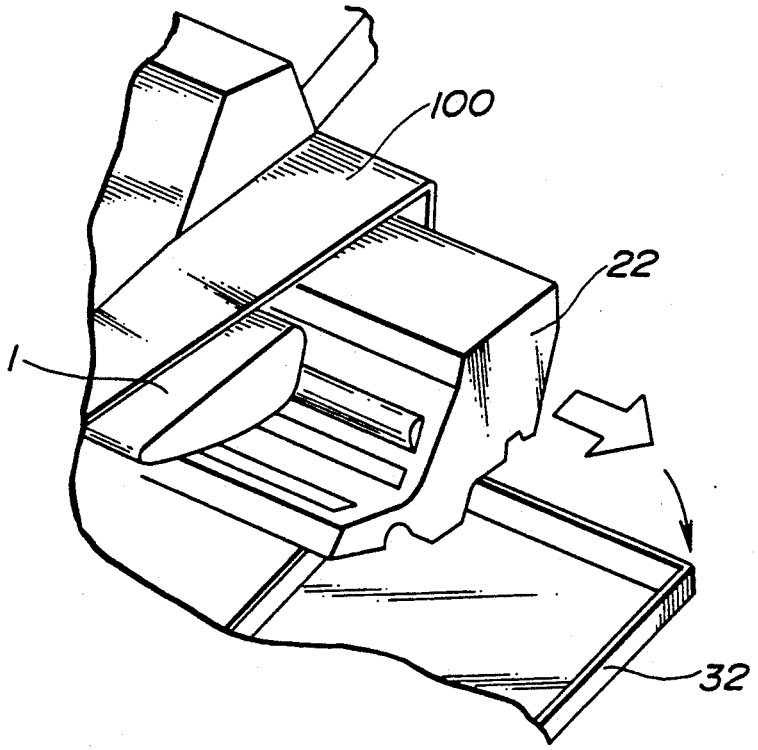
FIG. 3 is a perspective view showing a state where exchanging kit is pulled out from a housing.

A description will now be given of a second preferred embodiment of the present invention with reference to FIGS.2 and 3. FIG.2 shows a portion adjacent to the photosensitive belt 1 in a laser printer. In FIG.2, those parts which are the same as those shown in FIG.1 are given the same reference numbers.

Referring to FIG.2, the developing unit 3 and the dustproof cover 19*a* having the dustproof glass 19 are integrated by the frame 18 is the same manner described above and the charger unit 2 is connected to the dustproof cover 19*a* by a frame 18*a*. Thus, the charger unit 2, the developing unit 3, the dustproof cover 19*a* and the dustproof glass 19 are integrated, and they are housed in a housing 22*a* indicated by a heavy line in FIG.2. A surface of the charger unit 2 and a developer roller 3*a* of the developing unit 3 are respectively exposed from the housing 22*a*. A window 22*b* is provided on the housing 22*a*, and the laser beam emitted from the writing optical system 7 irradiates through the plate glass 28, the window 22*b* and the dustproof glass 19 to the photosensitive belt 1. An exchanging kit 22 is made up of the charger unit 2, the developing unit 3, the frames 18 and 18*a*, the dustproof cover 19*a*, the dustproof glass 19 and the housing 22*a*. Housing 22*a* of exchanging kit 22 includes a portion 41 which can be characterized as a guide plate 41 and is provided between the developer roller 3*a* of the developing unit 3 and the dustproof cover 19*a*. As is evident from the structure shown in FIGS. 2 and 3, this guide plate 41 can guide toner dropped from the developing unit 3 to a wall of the dustproof cover 19*a*. In addition, because as illustrated in FIG. 2 the dustproof cover 19*a* inclines with respect to a vertical direction, toner dropped from the lower end of the guide plate 41 would go to the lower wall of the dustproof cover 19*a*. An imaginary vertical line L extending down from the bottom end of the guide plate 41 does not interact the dustproof glass 19; hence, toner dropped from the bottom end of the guide plate 41 would not tend not to reach the dustproof glass 19. A first groove 35 and a second groove 36 are formed parallel to each other on a bottom of the housing 22*a* of the exchanging unit 22. A first bar 20 and a second bar 21 are provided parallel to each other in the housing 100 in a direction perpendicular to the sheet of FIG.2. The first groove 35 engages with the first bar 20 and the second groove 36 engages with the second bar 21 so that the exchanging kit 22 is slidably supported by the first bar 20 and the second bar 21. A door 32 is provided on the front of the housing 100. The door 32 is opened, and a fixing mechanism for fixing the exchanging kit 22 at a predetermined regular position is released so that it becomes possible for the exchanging kit 22 to be pulled out from the housing 100. Then, the exchanging kit 22 is pulled out along the first bar 20 and the second bar 21, and after that, a new exchanging unit 22 is inserted along the first bar 20 and the second bar 21 and the new exchanging kit 22 is loaded at the regular position.

In the second embodiment described above, when the toner in the developing unit 3 has been consumed for developing the latent image, the developing unit 3 must be exchanged for a new one so the exchanging kit 22 is pulled out from the housing 100 and is exchanged for a new one. Thus, it is unnecessary for both the charger unit 2 and the dustproof glass 19 to be separately pulled out and loaded into the regular position, and both the charger unit 2 and the dustproof glass 19 can be exchanged for new ones at the same time.

According to the present invention, when the toner in the developing unit has been consumed and so the developing unit is exchanged, the dustproof glass or the dustproof glass and charger unit are exchanged to new ones at the same time without a special operation. Thus, it is possible to prevent the picture quality from deteriorating without operations that the dustproof glass and charger unit are purposely detached and they are cleaned.

The present invention is not limited to the aforementioned embodiments, and variations and modifications may be made without departing from the scope of the claimed invention.

What is claimed is:

1. An image forming apparatus comprising:

a photosensitive member;

a charger unit provided at a charging station around said photosensitive member for uniformly charging said photosensitive member;

a writing optical system housed in a housing for casting an optical image of a document image onto said photosensitive member, said housing having a projection opening through which a light beam corresponding to the optical image from said writing optical system passes; and an exchanging kit having a developing unit provided at a developing station around said photosensitive member for developing an electrostatic latent image formed by casting the optical image on said photosensitive member and a dustproof cover integrated with said developing unit and covering said projection opening of said housing of said writing optical system, said dustproof cover having a dustproof glass through which the light beam passing through said projection opening passes, said exchanging kit being detachably provided around said photosensitive member, wherein said exchanging kit is provided above said writing optical system so that said projection opening of said housing of said writing optical system is positioned under said developing unit, and wherein said writing optical system casts the optical image between said charging station and said developing station on said photosensitive member.

2. An image forming apparatus as claimed in claim 1, wherein said photosensitive member comprises a photosensitive belt moving in a direction from said charging station to said developing station.

3. An image forming apparatus as claimed in claim 1, wherein said dustproof cover inclines with respect to a vertical direction to receive toner dropped from said developing unit.

4. An image forming apparatus as claimed in claim 1 further comprising a guide plate, provided between said developing unit and said dustproof cover and guiding toner dropped from said developing unit to said dustproof cover.

5. An image forming apparatus as claimed in claim 4, wherein said guide plate and said dustproof glass supported by said dust-proof cover are arranged such that an imaginary vertical line extending down from an end of said guide plate does not intersect said dustproof glass and toner dropped from said guide plate is directed to said dustproof cover.

6. An image forming apparatus comprising:

a photosensitive member;

a writing optical system housed in a housing and casting an optical image of a document image onto said photosensitive member, said housing having a projection opening through which a light beam corresponding to the optical image from said writing optical system passes; and an exchanging kit having a developing unit provided at a developing station around said photosensitive member for developing an electrostatic latent image formed by casting the optical image on said photosensitive member, a dustproof cover integrated with said developing unit and cover said projection opening of said housing of said writing optical system and a charger unit provided at a charging station around said photosensitive member and for uniformly charging said photosensitive member, said dustproof cover having a dustproof glass through which the light beam passing through said projection opening passes, said charger unit being integrated with said dustproof cover, and said exchanging kit being detachably provided around said photosensitive member, wherein said exchanging kit is provided above said writing optical system so that said projection opening of said housing of said writing optical system is positioned under said developing unit, and wherein said writing optical system casts the optical image between said charging station and said developing station on said photosensitive member.

7. An image forming apparatus as claimed in said claim 6, wherein said exchanging kit has housing means for housing said developing unit, said dust proof cover and said charger unit.

8. An image forming apparatus as claimed in claim 7, further comprising a plurality of bar members, wherein said housing of said exchanging kit is slidably supported by the plurality of said bar members, so that said housing slides on the plurality of said bar member and is exchanged.

9. An image forming apparatus as claimed in claim 6, wherein said dustproof cover inclines with respect to a vertical direction and receives toner dropped from said developing unit.

10. An image forming apparatus as claimed in claim 6 further comprising a guide plate, provided between said developing unit and said dustproof cover and guiding toner dropped from said developing unit to said dustproof cover.

11. An image forming apparatus as claimed in claim 10, wherein said guide plate and said dustproof glass supported by said dustproof cover are arranged such that an imaginary vertical line extending down from an end of said guide plate does not intersect said dustproof glass and toner dropped from said end of said guide plate is directed to said dustproof cover.

* * * * *